US006526684B1

(12) United States Patent
Hickerson

(10) Patent No.: US 6,526,684 B1
(45) Date of Patent: Mar. 4, 2003

(54) FIREARM SAFETY DEVICE

(76) Inventor: Frederick R. Hickerson, 15 Slate Pencil Hill Rd., Newton, NJ (US) 07860

( * ) Notice: Subject to any disclaimer, the term of this patent is extended or adjusted under 35 U.S.C. 154(b) by 0 days.

(21) Appl. No.: 09/543,285

(22) Filed: Apr. 5, 2000

(51) Int. Cl.[7] ..... F41A 17/00
(52) U.S. Cl. ..... 42/70.11; 42/70.01
(58) Field of Search ..... 42/70.01, 70.11

(56) References Cited

U.S. PATENT DOCUMENTS

| | | | | | |
|---|---|---|---|---|---|
| 2,478,098 | A | | 8/1949 | Hansen | 42/1 |
| 2,479,107 | A | | 8/1949 | Garretson | 42/70 |
| 2,887,807 | A | | 5/1959 | Santangelo | 42/1 |
| 3,768,189 | A | | 10/1973 | Goodrich | 42/1 N |
| 4,023,294 | A | | 5/1977 | Knopp | 42/1 LP |
| 4,084,341 | A | | 4/1978 | Cervantes | 42/1 Y |
| 4,136,476 | A | | 1/1979 | Hetrick | 42/1 LP |
| 4,224,753 | A | | 9/1980 | Bielman | 42/1 LP |
| 4,479,320 | A | | 10/1984 | Fix | 42/1 LP |
| 4,512,099 | A | | 4/1985 | Mathew | 42/1 LP |
| 4,569,144 | A | | 2/1986 | Thurber | 42/1 LP |
| 4,783,924 | A | | 11/1988 | Thurber | 42/70.11 |
| 4,908,971 | A | | 3/1990 | Chaney | 42/70.11 |
| 5,001,854 | A | | 3/1991 | Derman | 42/70.11 |
| 5,048,211 | A | | 9/1991 | Hepp | 42/70.11 |
| 5,138,785 | A | * | 8/1992 | Paterson | 42/66 |
| 5,224,615 | A | | 7/1993 | Hickerson | 215/218 |
| 5,239,767 | A | * | 8/1993 | Briley, Jr. et al. | 42/70.11 |
| 5,241,770 | A | * | 9/1993 | Lambert | 42/70.11 |
| 5,289,653 | A | * | 3/1994 | Szebeni et al. | 42/70.11 |
| 5,392,552 | A | | 2/1995 | McCarthy et al. | 42/70.07 |
| 5,488,794 | A | | 2/1996 | Arreguin | 42/70.11 |
| 5,561,935 | A | | 10/1996 | McCarthy et al. | 42/70.07 |
| 5,664,358 | A | * | 9/1997 | Haber et al. | 42/70.11 |

* cited by examiner

*Primary Examiner*—Michael J. Carone
*Assistant Examiner*—Kimberly S Smith

(57) ABSTRACT

A firearm safety device invention for handguns is disclosed. The safety device (10) prevents accidental firing of a gun by children, but is easily removable by an adult in 5 to 10 seconds even in pitch darkness. The safety device includes a lock sleeve (26) with an expandable end plug (30) which is inserted through the muzzle (16) of a gun barrel (14). With the end plug positioned in the firing chamber, a lock rod (24) is inserted into the lock sleeve to force expansion of the linear slotted (32) end plug sufficiently to prevent the safety device from being removed from the barrel. Withdrawal of the lock rod from the lock sleeve to allow removal of the safety device is prevented by a knurled cap (22) which is threadedly attached to a knurled enlarged end portion (28) of the lock sleeve. Since the safety device is able to rotate freely in its assembled position in the gun, any attempt to unscrew the knurled cap without holding the enlarged end portion of the lock sleeve stationary will be unsuccessful. A child will not be able to remove the knurled cap since he or she will hold the gun in one hand while fiddling with the knurled cap with the other hand.

7 Claims, 7 Drawing Sheets

FIREARM SAFETY DEVICE

CROSS-REFERENCE TO RELATED APPLICATIONS

Not applicable.

BACKGROUND—FIELD OF INVENTION

This invention relates to safety for firearms, specifically a device to securely block the chamber and barrel of a firearm to prevent its firing.

BACKGROUND: DESCRIPTION OF PRIOR ART

Children and other people are injured or killed by accidental shootings from loaded firearms which do not have preventative safety devices and which have been carelessly placed or stored where children can gain access to them. A recent publication estimated that 44 million Americans keep 65 million handguns in their homes.

Inventors and firearms manufacturers are working to develop and market "Personalized Smart Guns", ones that only the owner can fire. Patented inventions disclose a wide variety of safety lock systems, including finger print recognition, radio control, and magnetic control. Gun owners are not enthusiastic about using smart guns, with batteries, electronics, and magnets, because of the added cost and their questionable reliability for functioning properly in emergency situations.

For existing firearms and those still being sold, numerous patented safety devices to childproof these firearms have been invented and some are now on the market. Most of these safety devices either prevent access to the trigger or prevent a cartridge from being chambered or fired.

U.S. Pat. Nos. 5,392,552 and 5,561,935 both issued to McCarthy are examples of the "clam shell" type trigger lock, and U.S. Pat. No. 4,084,341 issued to Cervantes is an example of "block" type trigger lock. A variety of locks, including key, dial roller, combination, illuminated digital and etc. are used to prevent removal of trigger safety devices.

U.S. Pat. No. 4,136,476 issued to Hetrich, U.S. Pat. No. 4,224,753 issued to Bielman, and U.S. Pat. No. 4,908,971 issued to Chaney are examples of safety devices that have a dummy cartridge to block the chamber which is held in place by a key controlled barrel rod.

U.S. Pat. No. 4,023,294 issued to Knopp, U.S. Pat. No. 4,512,099 issued to Mathew, U.S. Pat. No. 4,569,144 issued to Thurber, U.S. Pat. No. 5,001,854 issued to Derman, and U.S. Pat. No. 5,048,211 issued to Hepp are examples of safety devices which block the barrel and cartridge chamber by use of rods and rod removal keys, etc.

One concern about trigger locks and blocks is that a careless gun owner will leave a live cartridge in the chamber of the gun and a child might cock the hammer into its firing position. The child might then continue to monkey around the trigger or drop the gun possibly causing it to fire. Also, gun owners are concerned with the effects gun locks have on their sense of security. Today's locks are mechanical devices requiring keys, combinations, etc., things that a person might not easily remember or locate in the middle of the night during an emergency situation.

The barrel block safety devices that attach to a dummy cartridge in the chamber assure that a live cartridge can not be chambered and fired. Generally a key rod fastens and unfastens the barrel block from the dummy cartridge. The amount of time required to find and use the key rod to remove the block from the gun barrel, remove the dummy cartridge and load the gun is of great concern to the gun owner.

The barrel block safety devices that go through the barrel and enter the dummy cartridge are locked in place by various means to prevent chambering a live cartridge. All have a removal system using a key rod, a cable, or a digital padlock, which causes an unacceptable delay for the gun owner.

My U.S. Pat. No. 5,224,615, for a child resistant container and safety closure, has provided background technology for an alternate embodiment of the invention.

SUMMARY OF THE INVENTION

The present invention is a firearm safety device for handguns and is designed to prevent accidental firing of a gun. The gun can not contain a live cartridge in the firing chamber with the safety device in position; however, the safety device can be removed quickly, even in the dark, by following a proper removal procedure which is childproof.

The safety device includes a lock sleeve with an expandable end plug, which is inserted through the muzzle of a gun barrel. With the end plug positioned in the firing chamber, a lock rod is inserted into the lock sleeve to force expansion of the linear slotted end plug sufficiently to prevent the safety device from being removed from the barrel. Withdrawal of the lock rod from the lock sleeve to allow removal of the safety device is prevented by a knurled cap, which is threadedly attached to a knurled enlarged end portion of the lock sleeve. Since the safety device is able to rotate freely in its assembled position in the gun, any attempt to unscrew the knurled cap without holding the knurled enlarged end portion of the lock sleeve stationary will be unsuccessful. A child will not be able to remove the knurled cap since he or she will hold the gun in one hand while fiddling with the knurled cap with the other hand.

OBJECTIVES AND ADVANTAGES

It is an object of my invention to provide a firearm safety device which may be easily applied to any handgun to prevent its firing by children and also be easily and quickly removed by the owner for emergency or other use.

It is also an object of my invention to provide a firearm safety device which, when positioned in a handgun, prevents a cartridge being in the firing chamber. Many other firearm safety devices such as clam shell type trigger guards, barrel locks, and trigger blocks are not designed to prevent a cartridge from being in the firing chamber. It is an accepted fact that dropping a loaded gun can sometimes result in its discharge.

Another object of my invention is to provide such a firearm safety device which is installable and removable entirely from the muzzle end of a gun barrel, without any scratching or other damage to the firearm.

Yet another object of my invention is to provide a firearm safety device of simple, rugged construction and with a high reliability of working properly.

Still another object of my invention is to provide a firearm safety device made of tough plastic material which can be inexpensively molded using current production machines and techniques.

A further object of my invention is to provide a firearm safety device which is childproof but can be removed from a firearm by an adult in 5 to 10 seconds, in pitch darkness using only a small physical force.

Another object of my invention is to provide a firearm safety device that when positioned in a handgun will extend out of the muzzle of the gun barrel as an indication that the firearm safety device is positioned within the handgun.

Still another object of my invention is to provide a firearm safety device which is adapted to be used with handguns of various types, i.e. revolver, semiautomatic and others and adapted to all different calibre handguns with different length barrels.

It is also an object of my invention to provide a firearm safety device which, in addition to being childproof, includes a secondary security system to prevent firing by unauthorized older children and adults.

Figure 1:
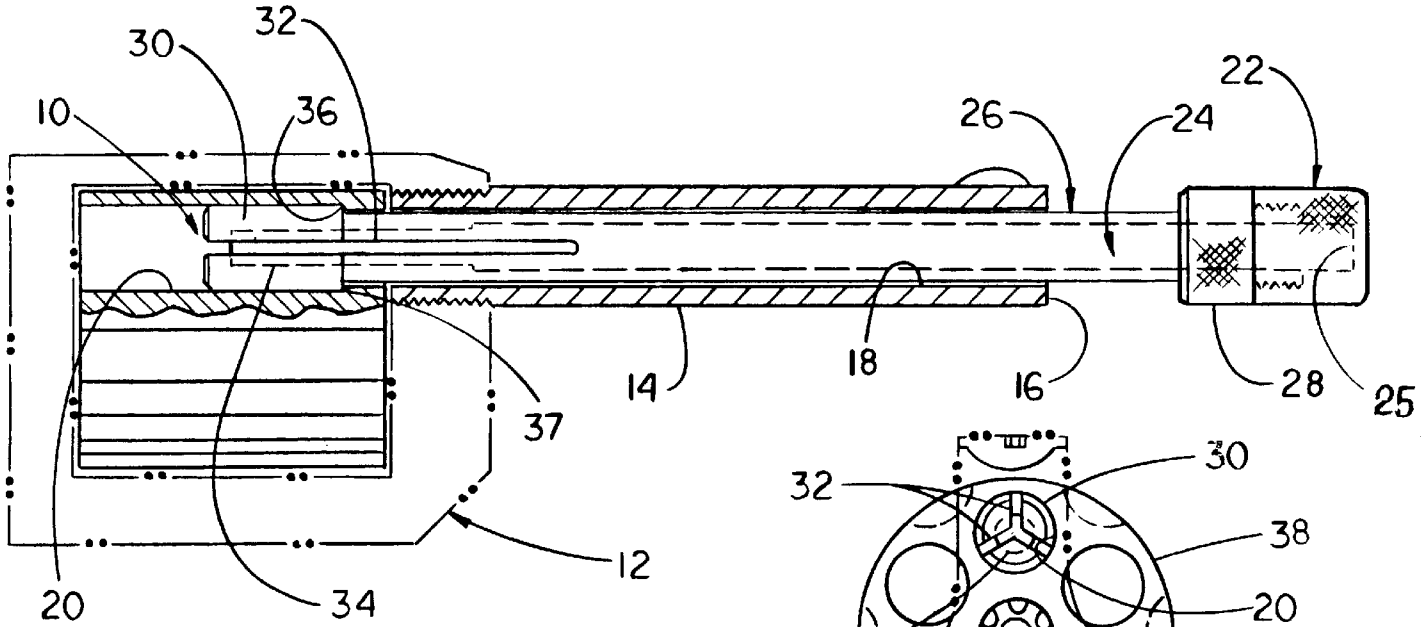
FIG. 1 is a side view, partly in cross-section, illustrating the firearm safety device invention assembled in the cylinder and barrel of a revolver handgun.

LIST OF REFERENCE NUMERALS 10 firearm safety device
12 revolver handgun
14 barrel
16 muzzle
18 bore
20 firing chamber
22 knurled cap
24 lock rod
25 circular cavity
26 lock sleeve
27 thread
28 knurled enlarged end portion
30 end plug
32 linear slot
34 small end portion
36 shoulder
37 shoulder
38 cylinder
40 semiautomatic handgun
42 hole
44 thread
46 junction
48 firearm safety device
50 lock sleeve
52 lock rod -continued 54 knurled cap
56 lock ring
58 enlarged end portion
60 extending tab
62 male thread
64 female thread
66 peripheral wall
68 neck groove portion
70 knurled outside surface
72 peripheral wall
74 outside serrated surface
76 small split
78 alignment bar or abutment
80 arcuate slot or recess
82 axis alignment shoulder
84 inside serrated surface
86 axis offset shoulder
88 longitudinal serration
89 lock clip
90 side rail
91 shackle
92 lock
93 hole

DESCRIPTION OF PREFERRED EMBODIMENTS FIGS. 1–5

Referring now to the drawings and more particularly FIG. 1, it can be seen that a firearm safety device according to the invention is designated generally by the numeral 10. As will become apparent herein, firearm safety device 10 is intended to serve as a firing chamber lock mechanism, securing the barrel and firing chamber of the firearm with which it is employed. Firearm safety device 10 shown in the assembly drawing of FIG. 1, for a revolver handgun 12, has a barrel 14 extending to a muzzle 16. A bore 18 extends axially into barrel 14 from muzzle 16 in standard fashion. As will become further apparent herein, bore 18 typically terminates at a firing chamber 20 of revolver handgun 12.

Figure 3:
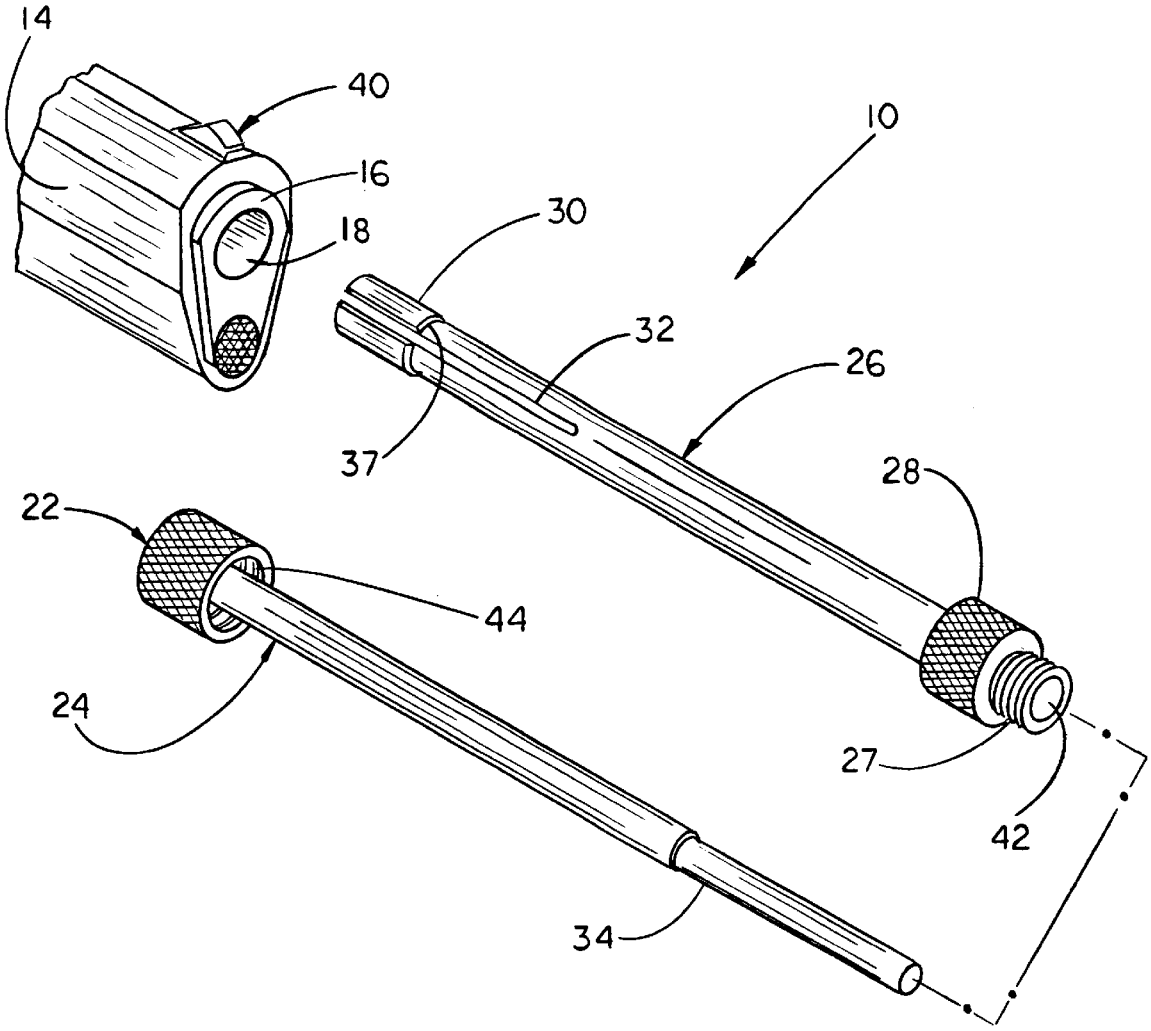
FIG. 3 is an assembly diagram of the safety device invention, shown in FIG. 1, as applicable to a semiautomatic handgun.

Firearm safety device 10 includes a knurled cap 22 with a lock rod 24 positioned in a circular cavity 25 of knurled cap 22. As shown, lock rod 24 is inside a lock sleeve 26 which is assembled in bore 18. Knurled cap 22 is threaded to a mating thread 27 on a knurled enlarged end portion 28 of lock sleeve 26, as shown in FIG. 3. An end plug 30 on lock sleeve 26 is positioned in firing chamber 20, preventing insertion of a cartridge into firing chamber 20. A number of linear slots 32 in end plug 30 provide the flexibility needed in the insertion and removal of end plug 30 from bore 18. As further shown in FIG. 1, lock sleeve 26 can not be removed from barrel 14 as lock rod 24, in touching contact with end plug 30, prevents the diametrical contraction of end plug 30 necessary for removal from barrel 14. Removal of lock rod 24 from lock sleeve 26 allows for contraction of end plug 30 and easy removal of lock sleeve 26 from barrel 14. As shown, a small end portion 34 of lock rod 24 extends the outside diameter of end plug 30 to a diameter more than the inside diameter of bore 18 but slightly less than the inside diameter of firing chamber 20, which allows free axial movement of end plug 30 within firing chamber 20 but prevents removal from barrel 14.

It will be appreciated by those skilled in the art that most of the firing chamber 20 has a slightly greater inside diameter than bore 18, the departure between the firing chamber 20 and bore 18 being defined by a shoulder 36 of the firing chamber 20 adapted for contacting the rim of a cartridge, and a shoulder 37 of the end plug 30.

Figure 2:
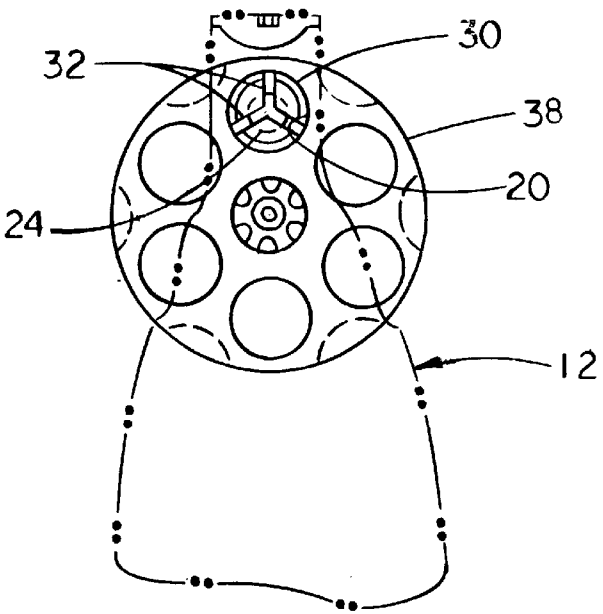
FIG. 2 is a rear broken away and phantom view of the revolver, showing an end view of the safety device invention in the firing chamber.

FIG. 2 is a rear view of a cylinder 38, in revolver handgun 12, showing end plug 30 of firearm safety device 10 positioned in firing chamber 20. Lock rod 24 forces diametrical expansion of end plug 30 to a diameter slightly less than the inside diameter of firing chamber 20 and sufficiently more than the inside diameter of bore 18 of barrel 14, preventing removal of firearm safety device 10 from revolver hand gun 12.

FIG. 3 is an assembly diagram of firearm safety device 10 disclosed and described in FIG. 1 and FIG. 2 as applied to a semiautomatic handgun 40. Firearm safety device 10 invention is designed to be used on most any type of handgun, i.e. revolver handgun 12, semiautomatic handgun 40 and others. The firearm safety device 10 is also designed to fit a wide range of handgun barrel lengths, since the knurled cap 22 end of firearm safety device 10 protrudes an inch or more from muzzle 16 of barrel 14. This allows firearm safety device 10 to be used in handguns with different length barrels. A stretched out, longer version of the invention can be made for use in handguns with extra long barrels.

Firearm safety device 10 is also designed for use in handguns of different calibres. The smallest calibre handgun which firearm safety device 10 can be used with must be slightly larger than the outside diameter of lock sleeve 26, to allow free axial movement of end plug 30 within firing chamber 20. The largest calibre handgun in which the firearm safety device 10 can be used is limited by the maximum diameter expansion of end plug 30. This maximum diameter occurs when the diameter of small end portion 34 of lock rod 24 is the same as the diameter of the rest of lock rod 24.

Firearm safety device 10 as designed covers a range of calibres spread apart by about 0.10 inches. To fit all calibre handguns, from say .22 to .50 calibre, about three different sizes of firearm safety device 10 would be necessary. For the small calibres, such as .22 and .25, it may be necessary to manufacture lock rod 24 from metal instead of plastic in order to provide added rigidity to firearm safety device 10.

When assembling lock sleeve 26 into bore 18 of barrel 14, end plug 30 which is flexible is easily guided into bore 18. Lock sleeve 26 is then pushed until end plug 30 fully enters firing chamber 20. With lock sleeve 26 in place, lock rod 24 is then fully inserted in a hole 42 of lock sleeve 26 to allow small end portion 34 of lock rod 24 to enter and expand end plug 30 of lock sleeve 26. After lock rod 24 is positioned in lock sleeve 26, a thread 44 on knurled cap 22 can be screwed together with thread 27 on the knurled enlarged end portion 28 of lock sleeve 26.

When removal of firearm safety device 10 is attempted, without first withdrawing lock rod 24, shoulder 37 of end plug 30 of lock sleeve 26 will abut against shoulder 36 of firing chamber 20 preventing removal of firearm safety device 10.

Figure 4:
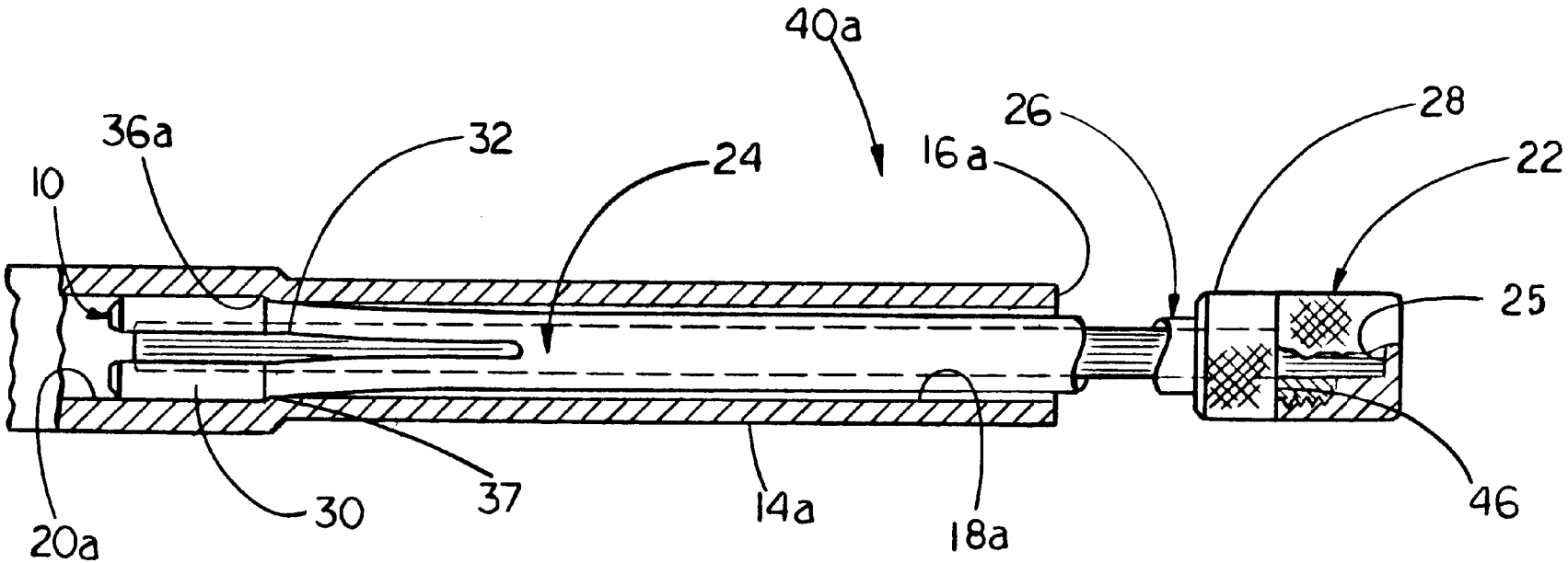
FIG. 4 is a side view, partly in cross-section, of the safety device invention assembled in the firing chamber and barrel of a relatively large calibre semiautomatic handgun.
Figure 5:
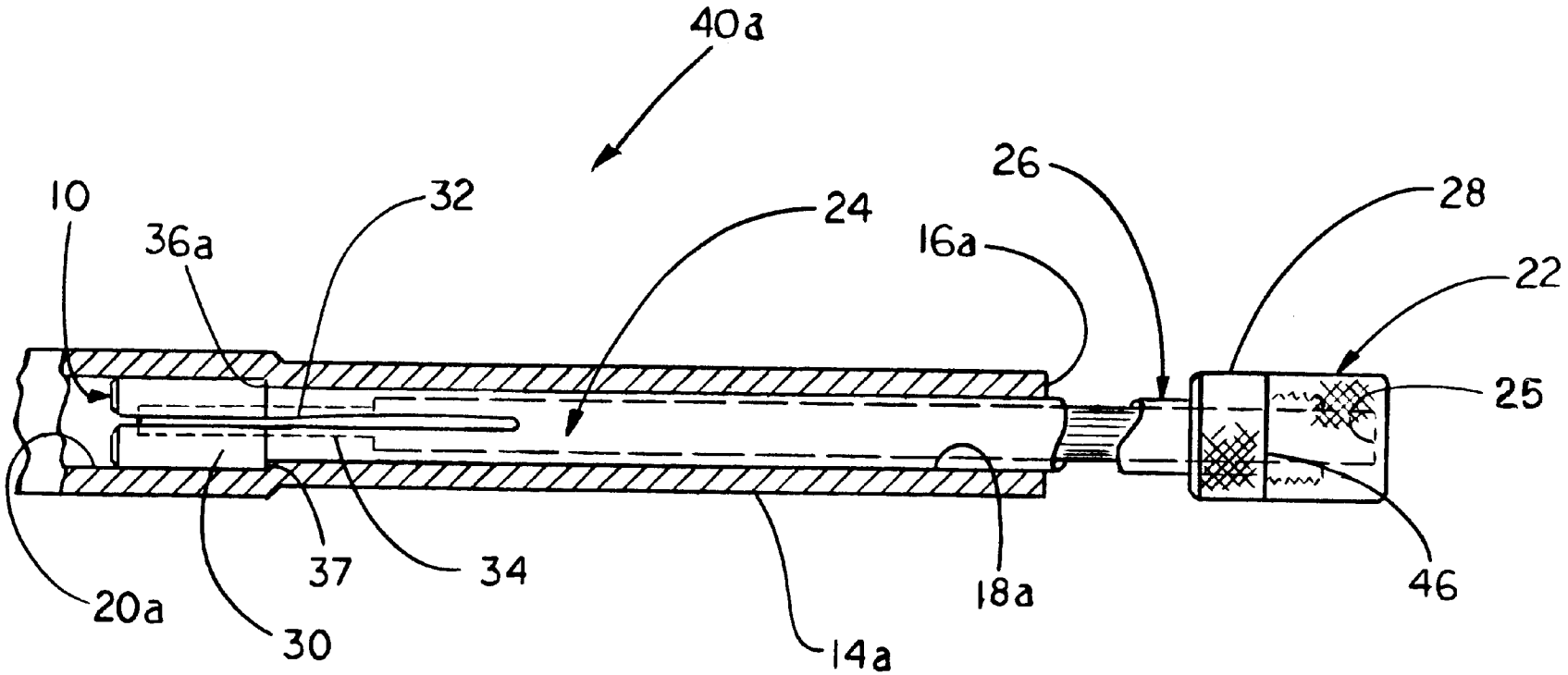
FIG. 5 is a side view, partly in cross-section of the safety device invention assembled in the firing chamber and barrel of a relatively small calibre semiautomatic handgun.

FIG. 4 shows firearm safety device 10 positioned in firing chamber 20*a* and barrel 14*a* of semiautomatic handgun 40*a* which is of larger calibre than semiautomatic handgun 40 shown in FIG. 3. In FIGS. 4 and 5, elements which are not interchangeable, but similar to those shown in FIG. 3, are identified with the same numerals followed by the letter "a". As shown in FIG. 4, small end portion 34 has a diameter equal to the rest of lock rod 24 which causes the fill outside diameter expansion of end plug 30. The flexibility needed in end plug 30 for expansion or contraction is provided by linear slots 32 in lock sleeve 26, as previously discussed.

A junction 46, between knurled cap 22 and knurled enlarged end portion 28 of lock sleeve 26, is a nearly invisible circular line where knurled cap 22 and knurled enlarged end portion 28 are joined. As assembled, firearm safety device 10 is free to rotate axially and also have some limited movement laterally as designed, but can not be removed from barrel 14*a* without following the proper removal procedure. A child attempting to remove firearm safety device 10 will rotate, push and pull knurled cap 22 but will be unsuccessful since the child will hold the handgun in one hand and try to remove knurled cap 22 with the other hand. It is highly unlikely the child will hold knurled enlarged end portion 28 stationary with one hand while unscrewing the tightly attached knurled cap 22 with the other hand, which is the proper removal procedure.

FIG. 5 shows firearm safety device 10 positioned in firing chamber 20*a* and barrel 14*a* of semiautomatic handgun 40*a* which is of smaller calibre than that shown in FIG. 4. As shown, lock rod 24 has a minimum diameter small end portion 34 which causes the outside diameter expansion of end plug 30 of lock sleeve 26. Linear slots 32 in lock sleeve 26 provide the flexibility required for expansion of end plug 30.

Firearm safety device 10 for revolver handgun 12 shown in FIGS. 1 and 2, and semiautomatic handguns 40 and 40*a* shown in FIGS. 3, 4, and 5 are basically the same. The only difference is, that for each different calibre handgun, small end portion 34 of lock rod 24 will necessarily have a correspondingly different diameter. As designed, firearm safety device 10 allows all of the different calibre matching lock rods 24 to interchangeably fit in circular cavity 25 of knurled cap 22.

DESCRIPTION OF ALTERNATE EMBODIMENTS, FIGS. 6, 7 AND 8

Figure 6:
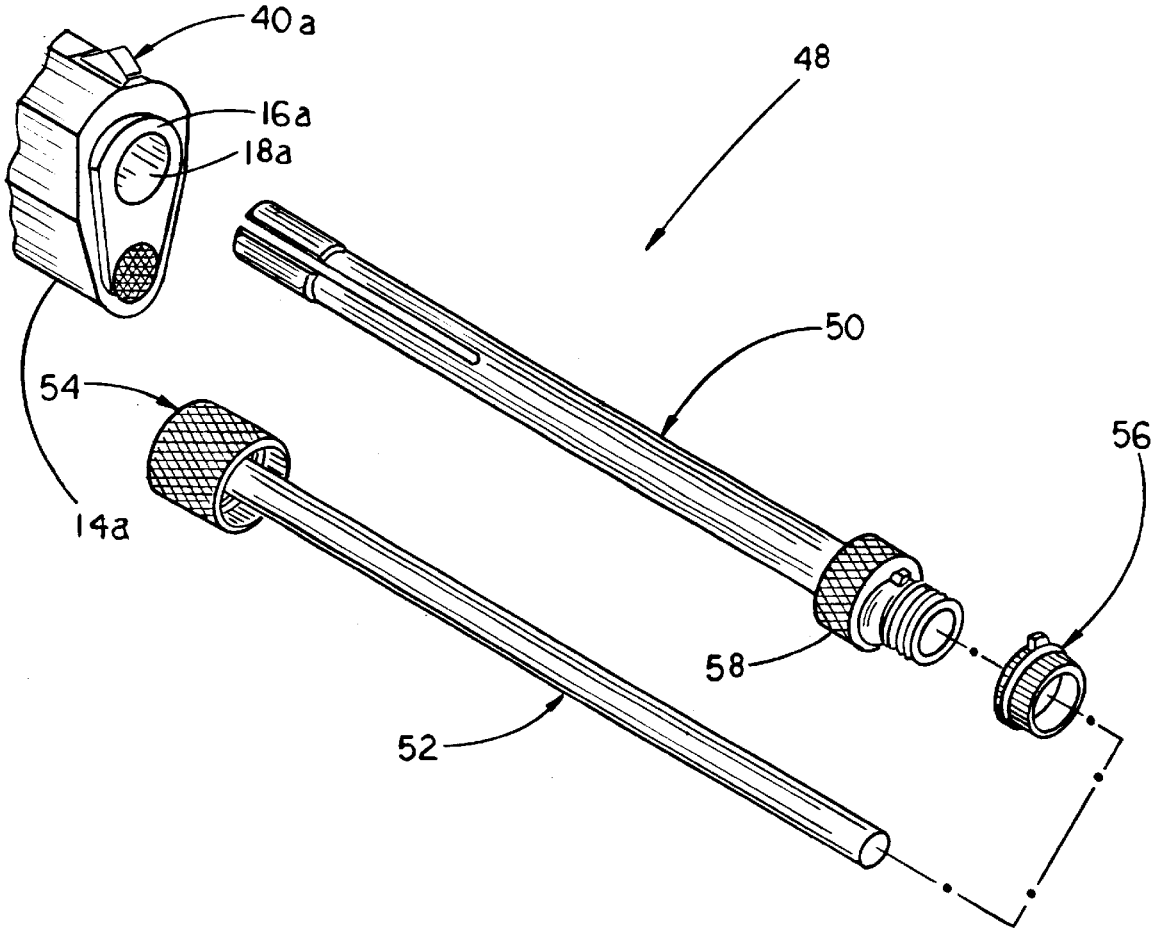
FIG. 6 is an assembly diagram of the safety device invention with an alternate embodiment showing another cap closure system.

FIG. 6 is an assembly diagram of a firearm safety device 48 showing an alternate embodiment of the invention utilizing a different childproofing method of securing a lock sleeve 50 of firearm safety device 48 in semiautomatic handgun 40*a*.

This different childproofing system as shown has a lock rod 52, a knurled cap 54, a lock ring 56, and an enlarged end portion 58 which attach together to prevent removal of firearm safety device 48. The alternate embodiment replaces knurled cap 22 and enlarged end portion 28 of firearm safety device 10, as shown in FIGS. 1, 4, and 5. All of the other design features of firearm safety device 10 and 48 are the same and have been adequately described herein.

A detailed description of the alternate embodiments is provided below, based on FIG. 7 which is an enlarged detailed assembly diagram of the portions of FIG. 6 which show design changes in the alternate childproofing method.

Figure 7:
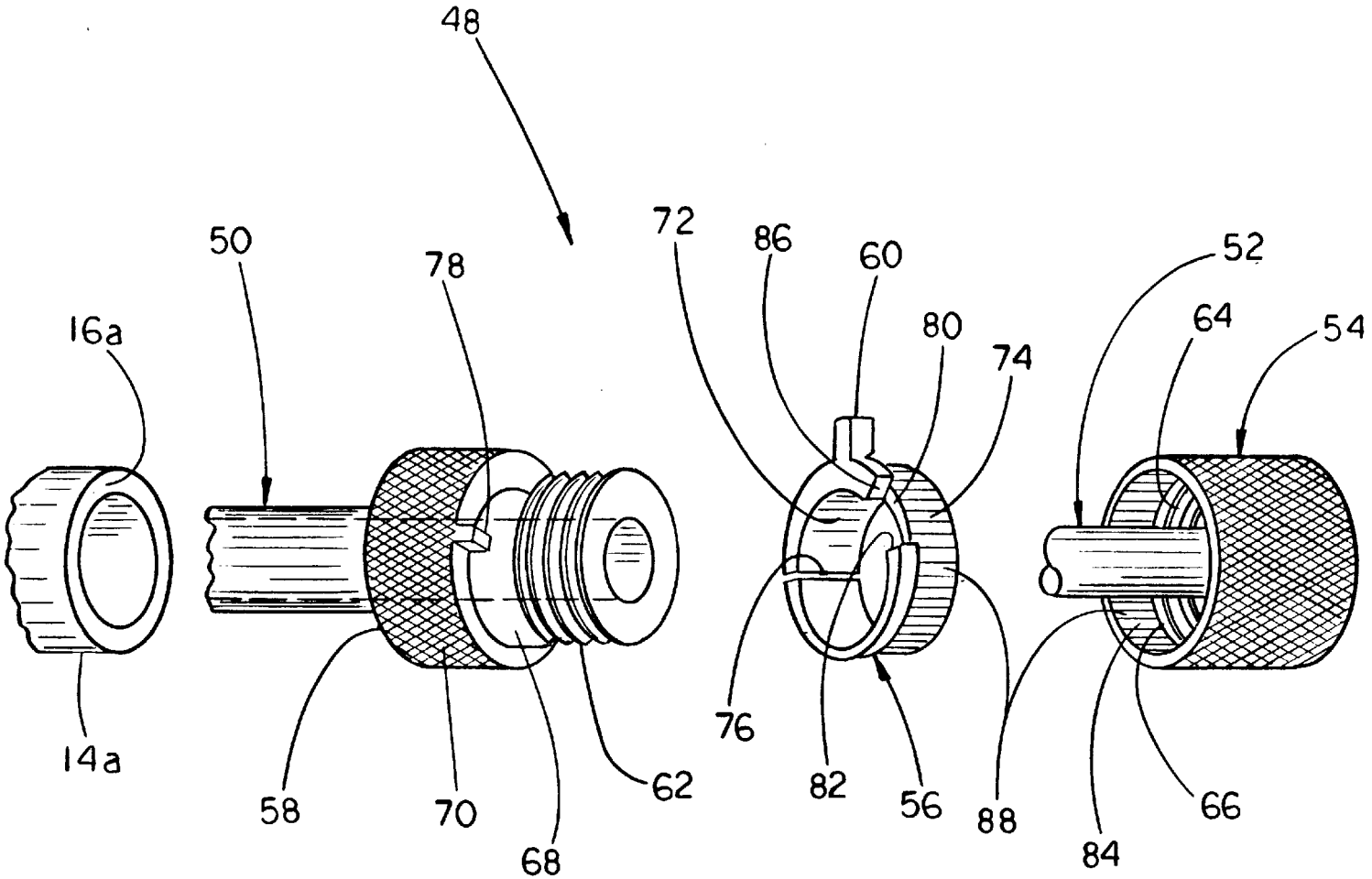
FIG. 7 is an enlarged, partly broken away, assembly diagram of the safety device invention alternate embodiment shown in FIG. 6.

FIG. 7 is an enlarged assembly diagram showing the portion of firearm safety device 48, shown in FIG. 6, which contains all of the design changes of the alternate embodiment. As shown, firearm safety device 48 consists of knurled cap 54, lock rod 52, lock ring 56, and enlarged end portion 58 of lock sleeve 50. An extending tab 60 on lock ring 56 is exposed and is designed to be held stationary during knurled cap 54 removal procedure. As shown, enlarged end portion 58 of lock sleeve 50 contains a male thread 62. A female thread 64, located inside a peripheral wall 66 of knurled cap 54, is contoured to freely fit male thread 62. Enlarged end portion 58 further has a neck groove portion 68, centrally located between male thread 62 and a circular knurled outside surface 70, which is intentionally formed with its axis offset from the central axis of male thread 62. Lock ring 56 is also formed to provide a same axis offset between the inside of a peripheral wall 72 and an outside serrated surface 74. Lock ring 56 rotatably engages neck groove portion 68 of enlarged end portion 58. A small split 76 in lock ring 56 allows lock ring 56 to be sprung open sufficiently to freely slide over male thread 62 into neck groove portion 68 of enlarged end portion 58 of lock sleeve 50. A radially disposed alignment bar or abutment 78 formed on neck groove portion 68 of enlarged end portion 58 is confined and surmounted by an arcuate slot or recess 80 in lock ring 56. With lock ring 56 engaged with neck grove portion 68 of enlarged end portion 58 and rotated clockwise, alignment bar or abutment 78 will be abuttingly engaged by an axis alignment shoulder 82 of arcuate slot or recess 80. The axis, described above for lock ring 56 and enlarged end portion 58, will then be in alignment with each other in accordance with an object of the invention. In this alignment position, outside serrated surface 74 of lock ring 56 will be concentric with an inside serrated surface 84 of knurled cap 54, and will allow knurled cap 54 to be threaded clockwise on enlarged end portion 58. This occurs as inside serrated surface 84 is designed to be concentric with female thread 64 of knurled cap 54. With knurled cap 54 threaded tightly to enlarged end portion 58, lock rod 52 will be securely contained within lock sleeve 50, preventing removal of firearm safety device 48. The proper manner of unthreading knurled cap 54 from enlarged end portion 58 is to hold extending tab 60 stationary. With extending tab 60 stationary, axis alignment shoulder 82 of lock ring 56 cannot rotate away from alignment bar or abutment 78, thus maintaining alignment as knurled cap 54 is unthreaded. The slight contact between outside serrated surface 74 and inside serrated surface 84 does not impede easy removal of knurled cap 54. When attempting to unthread knurled cap 54 from enlarged end portion 58 in an improper manner, i.e. by not holding extending tab 60 of the lock ring 56 to maintain necessary alignment, the counterclockwise rotation to unthread knurled cap 54 will cause lock ring 56 to rotate out of alignment. With lock ring 56 moving out of alignment into the safety or grip locking position against knurled cap 54, removal of the knurled cap 54 is prevented. Lock ring 56 rotates because of the initial light contact between outside serrated surface 74 and inside serrated surface 84. As lock ring 56 rotates counterclockwise, axis alignment shoulder 82 moves away from its alignment contact position against alignment bar or abutment 78. This movement causes the axes of lock ring 56 and enlarged end portion 58 to go out of alignment. With the offset axis of lock ring 56 moved off its alignment position, inside serrated surface 84 moves into an increasing jamming or grip locking relationship with outside serrated surface 74, and knurled cap 54 cannot be removed from enlarged end portion 58. In order to allow sufficient rotation of lock ring 56 to effect the grip lock of lock ring 56 and enlarged end portion 58, the extent of arcuate slot or recess 80 is such that an axis offset shoulder 86 of arcuate slot or recess 80 can not contact alignment bar or abutment 78 of enlarged end portion 58. A small longitudinal serration 88 on both outside serrated surface 74 of lock ring 56 and inside serrated surface 84 of enlarged end portion 58, illustrates the configuration of these serrations.

DESCRIPTION OF ALTERNATE EMBODIMENTS FIG. 8

Figure 8:
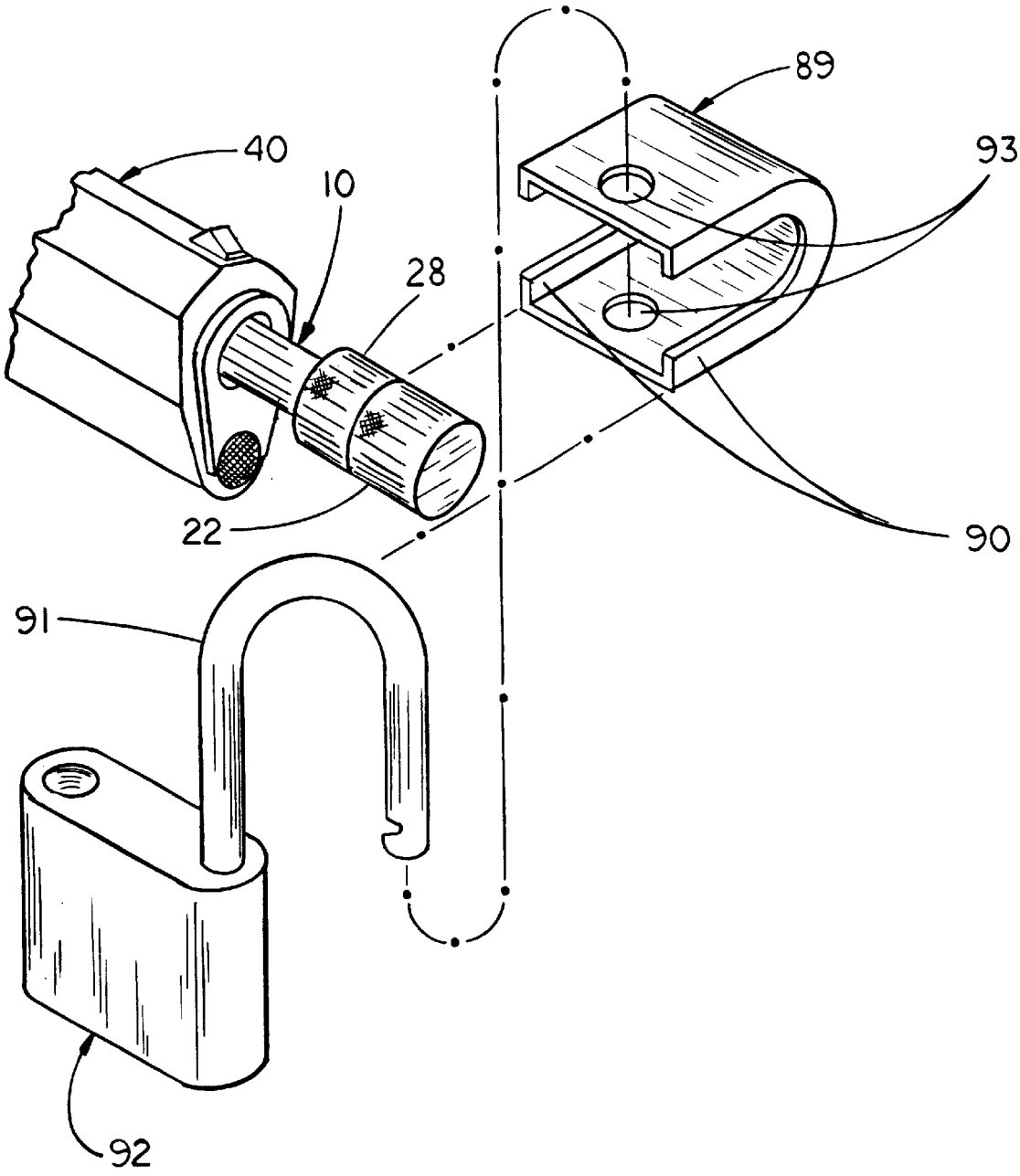
FIG. 8 is an assembly diagram of the safety device invention with another alternate embodiment showing the addition of a lock clip and padlock.

FIG. 8 is an assembly diagram of firearm safety device 10 with an added secondary security system. As shown this additional secondary security system has a lock clip 89 designed to assemble over both enlarged end portion 28 and attached knurled cap 22 of firearm safety device 10, while positioned in semiautomatic handgun 40. A side rail 90 on the top and bottom of each side of lock clip 89 enclose enlarged end portion 28 and attached cap 22 sufficiently to prevent unscrewing and removal of knurled cap 22 from enlarged end portion 28. Removal of knurled cap 22 is the key step in removing firearm safety device 10 from semiautomatic handgun 40 as previously disclosed.

With the lock clip 89 assembled over enlarged end portion 28 and attached cap 22, a shackle 91 of a padlock 92 is inserted through two holes 93 of lock clip 89 to prevent removal of lock clip 89. Padlock 92 can be of any type as long as shackle 91 has the proper length and diameter to fit through holes 93 of lock clip 89.

Operation of the Invention

The operational procedure for installing or removing firearm safety device 10 invention from revolver handgun 12, shown in FIG. 1, and semiautomatic handgun 40, shown in FIG. 3, is the same.

Assume that firearm safety device 10 is positioned within revolver handgun 12 and quick removal is necessary in an emergency situation. A person following the proper removal procedure will hold revolver handgun 12 in one hand and use several fingers of the same hand to hold knurled enlarged end portion 28 of lock sleeve 26 stationary, while unscrewing and removing knurled cap 22 and lock rod 24 with the other hand. Lock sleeve 26 can then be freely withdrawn from barrel 14 of revolver handgun 12 to complete the removal of handgun safety device 10.

Assuming now a child, in some way, has gained access to revolver handgun 12 with firearm safety device 10 positioned therein and tries to remove firearm safety device 10. The child will be unsuccessful despite various manipulations that will be tried. Holding revolver handgun 12 in one hand and trying to push, pull, and rotate knurled cap 22 in either direction with the other hand will be unsuccessful since firearm safety device 10 is designed to move freely back and forth a half inch or so and is free to rotate in either direction. Further, the child is physically unable to hold revolver handgun 12 and use fingers of the same hand to hold knurled enlarged end portion 28 of lock sleeve 26 stationary while trying with the other hand to remove knurled cap 22. Unscrewing knurled cap 22 is the key step in removal of firearm safety device 10 as explained above.

Efforts by two children, one holding revolver handgun 12 and the other pulling at firearm safety device 10, will fail to remove firearm safety device 10, as a test on a model of the invention showed that a pull of 120 pounds force was unsuccessful in removing firearm safety device 10.

FIGS. 6 and 7 illustrate an alternate embodiment of the invention. Firearm safety device 48 is basically the same as firearm safety device 10, since all portions that are positioned inside barrel **14*a* of semiautomatic handgun 40*a* are exactly the same as those of firearm safety device 10. Firearm safety device 48, however, has a different design for childproofing the safety removal system which includes knurled cap 54, lock ring 56 and enlarged end portion 58 of lock sleeve 50**.

Assume that firearm safety device 48 is positioned within semiautomatic handgun **40*a* and quick removal is necessary in an emergency situation. A person following the proper removal procedure will hold semiautomatic handgun 40*a* in one hand and use a finger of the same hand to hold extending tab 60 of lock ring 56 stationary. With lock ring 56 stationary and in the alignment position, knurled cap 54 can then be unscrewed and removed with the other hand along with lock rod 52, allowing lock sleeve 50 to be freely removed to complete the removal of firearm safety device 48**.

An attempt by a child to remove firearm safety device 48 in an improper manner will not be successful, despite various manipulations that will be tried. As previously discussed above, a child is physically unable to hold semi-automatic handgun 40*a* with one hand and using a finger of the same hand, hold stationary the extending tab 60 of lock ring 56, while with the other hand fiddling with knurled cap 54 in an unsuccessful removal effort.

FIG. 8 illustrates another alternate embodiment of the invention. With firearm safety device 10 positioned within semiautomatic handgun 40 and lock clip 89 assembled over knurled enlarged end portion 28 and knurled cap 22 of firearm safety device 10, shackle 91 of lock 92 can be positioned through holes 93 of lock clip 89 to allow lock to be locked in a conventional manner.

As previously disclosed, firearm safety device 10 provides childproofing for gun owners that require immediate access to firing their guns in emergency situations even in pitch darkness. The FIG. 8 additional lock safety system assembled to firearm safety device 10 is primarily designed to prevent unauthorized older children and adults from firing the gun. It is recognized that the added safety obtained by using a padlock prevents the gun owner from gaining immediate access to firing the gun, since locating a key, combination etc. needed to remove the padlock takes additional time. Removal of a padlock also requires visual observation and cannot be accomplished in pitch darkness. For the above reasons, the FIG. 8 alternate embodiment of the invention is designed primarily for gun owners, gun dealers and collectors that have guns which are not positioned or intended for protection in emergency situations.

It should be understood, while the drawings and their descriptions of the firearm safety device invention are shown for revolver and semiautomatic handguns, the invention can also be employed on nearly every cartridge type firearm including rifles and shotguns.

It should be further understood that the firearm safety device invention renders a firearm useless in so far as live ammunition is concerned and also makes it impossible to insert any foreign objects into the barrel which could cause problems. Also live cartridges can be stored safely in the firearm's magazine, clip, or cylinder to allow quick loading of the firing chamber once the firearm safety device has been removed. In addition the firearm safety device invention encourages gun owners to insect and maintain their firearms in a A particularly important advantage of this firearm safety device invention is the short time, 5 to 10 seconds, necessary for its removal from a firearm even in pitch darkness. The foregoing is considered as illustrative only of the principles of the invention. For example, lock rod 24 positioned in circular cavity 25 of knurled cap 22 could be molded as a single plastic part with no change to the invention or its operation. Also the childproof cap safety system shown in FIGS. 6 and 7 might be replaced by a different childproof bottle cap design. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A firearm safety device for insertion in a barrel and a firing chamber of a firearm to prevent firing comprising:

(a) a lock rod extending from a knurled cap;

(b) a lock sleeve in which said lock rod is positioned;

(c) a small end portion of said lock rod for expanding an end plug of said lock sleeve into a securing position in said firing chamber;

(d) said end plug of said lock sleeve further including a plurality of linear slots to allow the diametrical expansion of said end plug;

(e) means for attaching said lock rod to said lock sleeve, wherein said attachment means comprises said knurled cap and a knurled enlarged end portion tightly threadedly attached together having a nearly invisible line at a junction;

(f) a shoulder of said end plug abutting a shoulder in said firing chamber thereby preventing withdrawal of said lock sleeve from said firing chamber; and (g) an additional safety system consisting of a lock clip having a plurality of side rails assembled over said knurled cap and said knurled enlarged end portion to prevent withdrawal of said knurled cap and said lock rod from said lock sleeve, said lock clip having a shackle of a lock inserted through a hole in said lock clip to prevent removal of said firearm safety device.

2. The firearm safety device as defined in claim 1 wherein said lock rod, said lock sleeve and said knurled cap are plastic.

3. The firearm safety device as defined in claim 1 wherein said lock rod and said knurled cap are a single part.

4. The firearm safety device as defined in claim 1 wherein said small end portion of said lock rod may have a different diameter to expand said end plug of said lock sleeve for different caliber handguns.

5. The firearm safety device as defined in claim 1 wherein the expanded diameter of said end plug of said lock sleeve is greater than the diameter of a bore of said barrel and less than the diameter of said firing chamber.

6. A firearm safety device for insertion in a barrel and a firing chamber of a revolver handgun or a semi-automatic handgun to prevent firing comprising:

(a) a lock rod extending from a knurled cap;

(b) a lock sleeve in which said lock rod is positioned;

(c) a small end portion of said lock rod for expanding an end plug of said lock sleeve into a securing position in said firing chamber;

(d) said end plug of said lock sleeve further including a plurality of linear slots to allow diametrical expansion of said end plug;

(e) means for attaching said lock rod to said locks sleeve, and;

(f) a shoulder of said end plug abutting a shoulder in said firing chamber preventing withdrawal of said lock sleeve from said firing chamber, wherein said attachment means securing said lock rod in said lock sleeve comprises;

(i) an enlarged end portion having a neck groove portion defining an axis which is offset from a central axis defined by said enlarged end portion, said neck groove portion having an alignment abutment;

(ii) a knurled cap with a lock rod attached in rotatably removable threaded engagement with said enlarged end portion for securing said lock rod in said sleeve, said knurled cap having an inner peripheral wall, said inner peripheral wall having a serrated surface and said enlarged end portion having a knurled outside surface;

(iii) a lock ring with a small split having an outside serrated surface defining a central axis of said lock ring, said lock ring having an inner peripheral wall with an arcuate recess defining an axis alignment shoulder and an axis offset shoulder, said lock ring being rotatively engaged in said neck groove portion of said enlarged end portion;

(iv) said lock ring having an alignment means for controlling the rotation of said lock ring wherein the rotation of a first direction causes said axis alignment shoulder of said lock ring to effect an abutting engagement with said alignment abutment of said enlarged end portion, said central axis of said lock ring aligning with said central axis of said enlarged end portion with said outside serrated surface of said lock ring being in slight touching contact with said inside serrated surface on said peripheral wall of said knurled cap thereby allowing removal of said knurled, cap, said lock rod and said sleeve;

(v) wherein the rotation of said lock ring in a second direction causes said axis offset shoulder of said lock ring to approach an abutting engagement with said alignment abutment of said enlarged end portion, said central axis of said lock ring being offset from the central axis of said enlarged end portion, with said outside serrated surface of said lock ring being engaged with said inside serrated surface of said peripheral wall of said knurled cap thereby preventing removal of said knurled cap to prevent removal of said lock rod and said lock sleeve.

7. The firearm safety device as defined in claim 6 further includes said alignment means comprising an extending tab extending outwardly from said lock ring for effecting rotation of said lock ring.

* * * * *